US009337544B2

(12) United States Patent
Theunissen et al.

(10) Patent No.: US 9,337,544 B2
(45) Date of Patent: May 10, 2016

(54) CONFIGURABLE BACKING STRUCTURE FOR A REFLECTOR ANTENNA AND CORRECTIVE SYNTHESIS FOR MECHANICAL ADJUSTMENT THEREOF

(71) Applicant: Lockheed Martin Corporation, Bethesda, MD (US)

(72) Inventors: Wilhelmus H. Theunissen, Langhorne, PA (US); Eric Talley, Hamilton, NJ (US); William D. Brokaw, Annandale, NJ (US); James Howard Sturges, Jamison, PA (US); Nathaniel David Cantor, Princeton, NJ (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 221 days.

(21) Appl. No.: 14/148,618

(22) Filed: Jan. 6, 2014

(65) Prior Publication Data

US 2014/0191925 A1 Jul. 10, 2014

Related U.S. Application Data

(60) Provisional application No. 61/749,850, filed on Jan. 7, 2013, provisional application No. 61/812,657, filed on Apr. 16, 2013.

(51) Int. Cl.

| | |
|---|---|
| ***H01Q 15/14*** | (2006.01) |
| ***H01Q 1/12*** | (2006.01) |
| ***H01Q 1/28*** | (2006.01) |

(52) U.S. Cl.

CPC ..... *H01Q 15/14* (2013.01); *H01Q 1/12* (2013.01); *H01Q 1/288* (2013.01); *H01Q 15/148* (2013.01); *Y10T 29/49769* (2015.01)

(58) Field of Classification Search

CPC ..... H01Q 15/148; H01Q 15/20; H01Q 1/08; H01Q 1/12

USPC ..... 343/880, 912, 915

See application file for complete search history.

(56) References Cited

U.S. PATENT DOCUMENTS

| | | | | |
|---|---|---|---|---|
| 3,377,595 | A | 4/1968 | Carr | |
| 4,171,876 | A * | 10/1979 | Wood | F24J 2/12 126/570 |
| 4,295,709 | A | 10/1981 | Wood | |
| 4,750,002 | A | 6/1988 | Kommineni | |
| 4,845,510 | A | 7/1989 | Chang et al. | |
| 5,680,145 | A * | 10/1997 | Thomson | F24J 2/125 343/840 |
| 5,963,182 | A | 10/1999 | Bassily | |
| 2003/0201949 | A1 | 10/2003 | Harless | |
| 2008/0204352 | A1 | 8/2008 | Reynolds et al. | |
| 2013/0076590 | A1 | 3/2013 | Baudasse et al. | |

* cited by examiner

*Primary Examiner* — Hoang V Nguyen

(74) *Attorney, Agent, or Firm* — McDermott Will & Emery LLP

(57) ABSTRACT

A reflector support system is provided that includes a backing structure having a plurality of struts. The backing structure may have a plurality of hubs, each of the plurality of hubs may be configured to couple to two or more of the plurality of struts, each of the plurality of hubs may be configured to couple to another one of the plurality of hubs using one of the plurality of struts, each of the plurality of struts is configured to couple to at least two of the plurality of hubs. The backing structure may have a plurality of feet, each of the plurality of feet configured to couple to a corresponding one of the plurality of hubs, the plurality of feet are configured to couple to a reflector. In addition, a synthesis for mechanical adjustment of the reflector support system is provided.

15 Claims, 11 Drawing Sheets

CONFIGURABLE BACKING STRUCTURE FOR A REFLECTOR ANTENNA AND CORRECTIVE SYNTHESIS FOR MECHANICAL ADJUSTMENT THEREOF

CROSS-REFERENCE TO RELATED APPLICATIONS

The present application claims the benefit of priority from U.S. Provisional Patent Application Ser. No. 61/749,850, entitled "Fast Corrective Synthesis for Mechanical Adjustment of Reflector Antenna Surfaces," filed on Jan. 7, 2013, and also claims the benefit of priority from U.S. Provisional Patent Application Ser. No. 61/812,657, entitled "Configurable Backing Structure for a Reflector," filed on Apr. 16, 2013, all of which are hereby incorporated by reference in their entirety for all purposes.

STATEMENT REGARDING FEDERALLY SPONSORED RESEARCH OR DEVELOPMENT

Not applicable.

FIELD

The present disclosure generally relates to antenna reflector structures and systems, and more particularly to, for example, without limitation, backing structures for reflectors and corrective synthesis for mechanical adjustment thereof.

BACKGROUND

Communication antennas on Earth-orbiting satellites typically include a reflector to shape and focus the radio frequency (RF) beam to provide the desired ground coverage. To survive the launch loads and maintain surface accuracy, conventional systems provide backside stiffening structures of composite laminate and/or sandwich panel construction. As the frequency of the RF system increases, the required accuracy of the reflecting surface increases.

Traditional backside stiffening structures for space-based antenna reflectors are constructed of reinforced composite membrane or honeycomb sandwich construction using high-strength fibers such as graphite with a resin such as epoxy. The reflecting shell is typically attached to the backside structure by bonding using discrete or continuous bonds with or without localized shear clip or edge-bond enhancing features along the stiffening structure at the intersection of the structure and the backside reflecting shell. The backside stiffening structure is unique to the reflecting surface in that it is cut to fit the contour of the reflecting shell. Each unique RF surface profile results in a unique design solution for the backside stiffening structure. Creating a new backside structure for each reflecting surface profile increases the recurring cost of the reflector design and fabrication and drives recurring schedule.

In addition, low mass and low cost antenna reflectors used on satellites may show surface distortion over time. The surface distortion can be due to manufacturing process variations or environmental stress resulting from thermal or hygroscopic effects. The surface distortion in antenna reflectors can cause a loss in the efficiency of the antenna that has to be compensated by the rest of the chain, adding cost and increased power requirements. The compensation to be performed by the rest of the chain can be expensive, if not impossible.

The surface distortion problem is conventionally solved by making backing structure ribs and rings very stiff and weighing the reflector shell down on its mold during attachment. This solution may add structural mass to the resulting antenna and may not guarantee to work, since the built-in stress may cause errors that are hard to predict beforehand.

SUMMARY

According to one or more implementations of the present disclosure, an antenna reflector support apparatus is provided. The antenna reflector support apparatus may include a backing structure. The backing structure may include a plurality of struts. The backing structure may include a plurality of hubs, each of the plurality of hubs configured to couple to two or more of the plurality of struts, each of the plurality of hubs is configured to couple to another one of the plurality of hubs using one of the plurality of struts, each of the plurality of struts is configured to couple to at least two of the plurality of hubs. The backing structure may include a plurality of feet, each of the plurality of feet configured to couple to a corresponding one of the plurality of hubs, the plurality of feet are configured to couple to a reflector. The plurality of struts, the plurality of hubs, and the plurality of feet of the backing structure may be configured to allow the backing structure to have a grid structure.

According to one or more implementations of the present disclosure, a method is provided. The method may include forming a backing structure. The backing structure may include a plurality of struts. The backing structure may include a plurality of hubs coupled to the plurality of struts. The backing structure may include a plurality of feet coupled to the plurality of hubs, the plurality of feet coupled to a reflector. The method may include mounting photogrammetry targets to a surface of the reflector. The method may include measuring a point cloud using the mounted photogrammetry targets. The method may include calculating an error surface of the reflector surface based on the measured point cloud. The method may include calculating adjustment amplitudes based on the calculated error surface. The method may include adjusting the distance between the plurality of feet and the hubs based on the adjustment amplitudes.

The foregoing has outlined the features of the present disclosure in order that the detailed description that follows can be better understood. Additional features and advantages of the disclosure will be described hereinafter. These and other advantages and features will become more apparent from the following description taken in conjunction with the drawings.

BRIEF DESCRIPTION OF THE DRAWINGS

The accompanying drawings, which are included to provide further understanding and are incorporated in and constitute a part of this specification, illustrate disclosed aspects and together with the description serve to explain the principles of the disclosed aspects. In the drawings.

DETAILED DESCRIPTION

Figure 1:
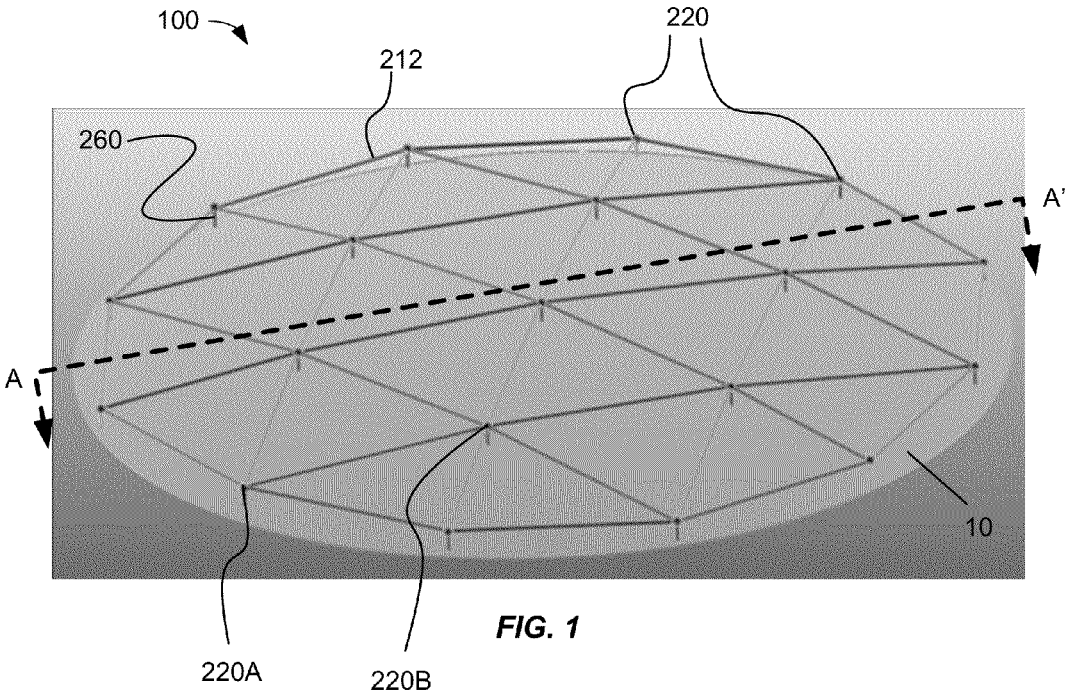
FIG. 1 is a perspective view of an antenna reflector system according to certain aspects of the present disclosure.

In one or more implementations, a backing structure that can be configured to support reflectors having a range of configurations and corrective synthesis for mechanical adjustment of the backing structure is disclosed herein.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. In some instances, well-known structures and components are shown in block diagram form in order to avoid obscuring the concepts of the subject technology. Like components are labeled with identical element numbers for ease of understanding.

While the concepts and features of the configurable backing structure are presented in terms of a reflector used in a radio frequency (RF) communication antenna adapted for use on a spacecraft, those of ordinary skill in the art will recognize that the same systems and methods may be utilized for other applications such as a radar system or a radio or optical telescope as well as ground-based systems. Nothing in this disclosure shall be construed as limiting the scope of the disclosed systems and features to RF communication systems or space-based applications.

Space based RF antenna reflectors typically have unique surface shape or geometry dependent on the desired ground coverage from the satellite on-orbit location. The unique shaped surface geometries result in unique structural backing support/mounting solutions required for each reflector with a high recurring cost for design and fabrication.

Existing techniques for creating backside stiffening structures involve creating a backside stiffening structure that is unique to the reflecting surface, in that it is cut to fit the contour of the reflecting shell. Therefore, each unique RF surface profile results in a unique design solution for the backside stiffening structure. Because unique design solutions must be made for each unique RF surface profile, cost of reflector design and fabrication is incurred with each unique RF surface profile. A preferred approach would be to use a configurable backing structure design that can be adjusted to support and correct surface errors of the appropriate RF surface profile.

In addition, low mass and low cost antenna reflectors used on satellites may show surface distortion over time. The surface distortion can be due to manufacturing process variations or environmental stress resulting from thermal or hygroscopic effects. The surface distortion in antenna reflectors can cause a loss in the efficiency of the antenna that has to be compensated by the rest of the chain, adding cost and increased power requirements. The compensation to be performed by the rest of the chain can be expensive, if not impossible. Conventionally, the surface distortion problem is solved by making backing structure ribs and/or rings very stiff and weighing the reflector shell down on its mold with sandbags during attachment. This solution may add mass to the resulting antenna and may not guarantee to work, since the built in stress may cause errors that are hard to predict beforehand. A preferred approach to correcting surface distortions on the reflector would be to adjust various points on the backing structure in order to achieve the desired reflector surface.

A disclosed approach is a systematic approach using linear superposition of amplitude basis functions calculated using structural finite element analysis, and solving for the adjustor amplitudes from measured error surfaces that can be calculated and preset after manufacture.

FIG. 1 is a perspective view of an antenna reflector system 100 according to certain aspects of the present disclosure. FIG. 1 shows a plurality of hubs 220 connected by a plurality of struts 212. The hubs 220 and struts 212 form a backing truss. FIG. 1 also shows an adaptive mounting system comprising a plurality of feet 260. The adaptive mounting system is connected to the backing truss to form the reflector support system. The reflector support system attaches to an RF reflector 10. In some aspects, the antenna reflector system 100 may be a kit of struts 212, hubs 220, and feet 260. In some aspects, the antenna reflector system 100 may be assembled, wherein the struts 212, hubs 220, and feet 260 are coupled to one another. In some aspects, the assembled antenna reflector system 100 may be attached to a reflector 10. In some aspects, the struts 212 and the hubs 220 are configured to allow the backing structure (or the backing truss) to have a grid structure. In some aspects, the grid structure is an isogrid. In some aspects, the hubs 220 and the feet 260 are configured to allow a bottom shape (e.g., the shape of an imaginary surface formed by connecting the bottom of all of the feet 260 configured to be attached, or attached, to the reflector 10) of the backing structure to substantially conform to an outer shape of the reflector 10.

In one or more implementations, the struts 212 each may have the same shape and size as the other struts 212. The feet 260 each may have the same shape and size as the other feet 260. The hubs (e.g., 220A) located on the outer edge of the backing truss 210 may have the same shape and size as the other hubs (e.g., 220A) located on the outer edge of the backing truss 210. The hubs (e.g., 220B) located within the inner portion of the backing truss 210 have the same shape and size as the other hubs (e.g., 220B) located within the inner portion of the backing truss 210. The struts 212, feet 260, and hubs 220 may be all rigid.

Figure 2A:
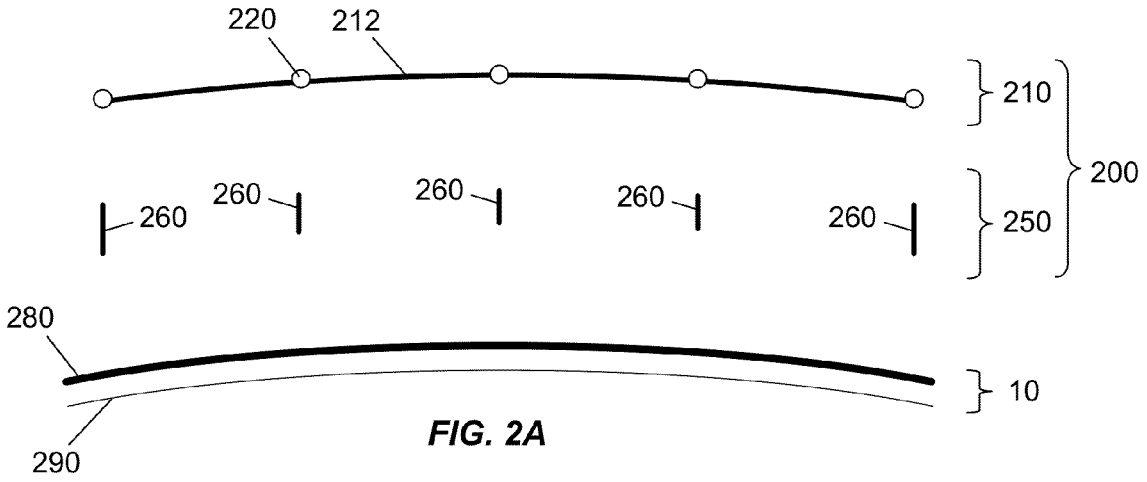
FIGS. 2A and 2B are schematic depictions of the antenna reflector system of FIG. 1 according to certain aspects of the present disclosure.
Figure 2B:
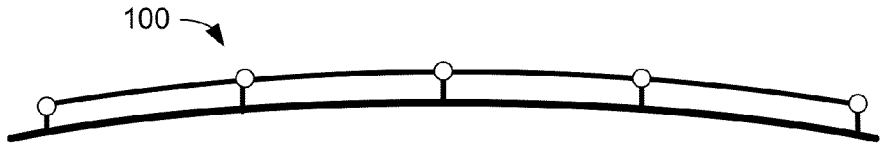

FIGS. 2A and 2B are schematic depictions of the antenna reflector system of FIG. 1 according to certain aspects of the present disclosure. FIG. 2A is an exploded view separating the backing truss 210 having struts 212 and hubs 220 from an adaptive mounting system 250 comprising a plurality of feet 260. The backing truss 210 and adaptive mounting system 250 together form a reflector support system 200 that attaches to the RF reflector 10. FIG. 2B shows the assembled antenna reflector system 100 in the same schematic form along an A-A' plane in FIG. 1. In one or more implementations, the diameter of the backing truss 210 is less than the diameter of the reflector 10 but greater than at least one half of the diameter of the reflector (e.g., about 60%, 70%, 80%, 90% or 95% of the diameter of the reflector). The hubs 220 may be all located on any surface so that the backing truss 210 (or the top outer surface of the reflector antenna system 100) is spherical (see, e.g., FIGS. 2A, 2B, 3A and 3B) to reduce the stowed reflector profile. In this case, the reflector has a curvature (e.g., not flat), and the backing truss 210 may also have a curved, spherical surface designed to accommodate families of reflectors with varying diameters and F/D ratios. In one or more implementations, two reflectors may be stowed on each side of a spacecraft.

Figure 2C:
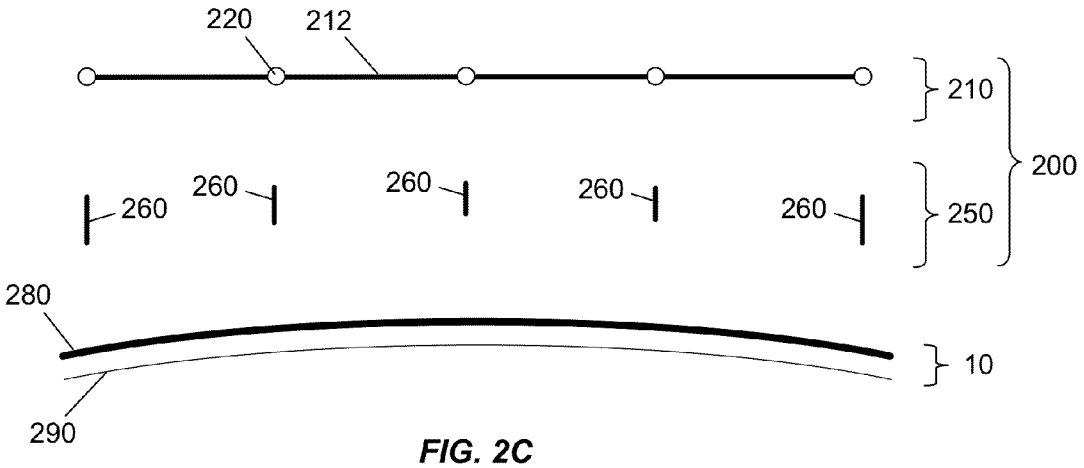
FIGS. 2C and 2D are schematic depictions of the antenna reflector system of FIG. 1 according to certain aspects of the present disclosure.
Figure 2D:
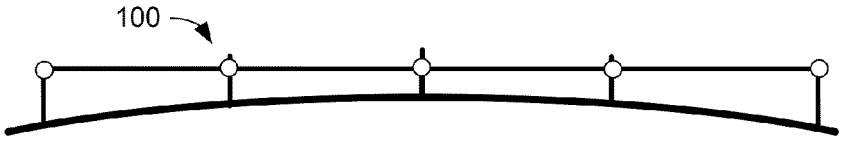

FIGS. 2C and 2D are schematic depictions of the antenna reflector system of FIG. 1 according to certain aspects of the present disclosure. FIG. 2C is an exploded view separating the backing truss 210 having struts 212 and hubs 220 from an adaptive mounting system 250 comprising a plurality of feet 260. The backing truss 210 and adaptive mounting system 250 together form a reflector support system 200 that attaches to the RF reflector 10. FIG. 2D shows the assembled antenna reflector system 100 in the same schematic form along an A-A' plane in FIG. 1. In one or more implementations, the diameter of the backing truss 210 is less than the diameter of the reflector 10 but greater than at least one half of the diameter of the reflector (e.g., about 60%, 70%, 80%, 90% or 95% of the diameter of the reflector). The hubs 220 may be all coplanar so that the backing truss 210 (or the top outer surface of the reflector antenna system 100) is flat (see, e.g., FIGS. 2C and 2D). In this case, while the reflector may have a curvature (e.g., not flat), the backing truss 210 does not have a curvature and does not conform to the shape of the reflector.

Figure 3A:
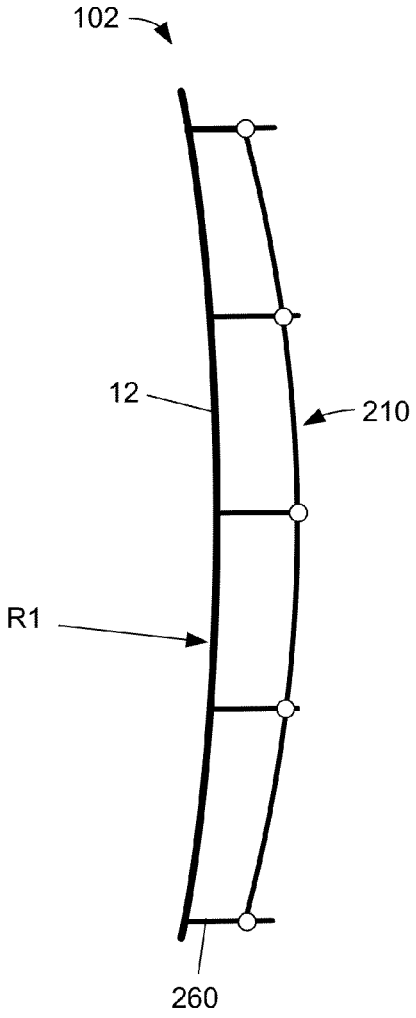
FIGS. 3A and 3B are schematic depictions of additional example antenna reflector systems according to certain aspects of the present disclosure.
Figure 3B:
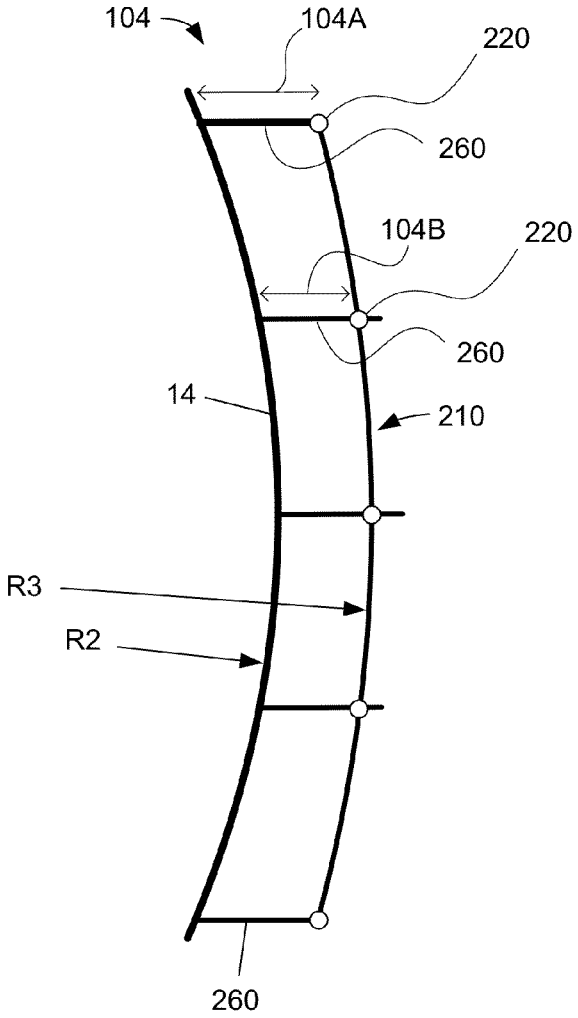

FIGS. 3A and 3B are schematic depictions of additional example antenna reflector systems 102, 104 according to certain aspects of the present disclosure. The shape of a reflector may be dependent upon, among other things, the beam-forming requirements and choice of frequencies for that particular system. FIG. 3A shows an antenna reflector system 102 having a reflector 12 having a relatively large radius R1 while FIG. 3B shows an antenna reflector system 104 having a reflector 14 with a smaller radius R2. In certain aspects, the backing truss 210 is configured to have a circular radius R3 that may be larger than either of R1 and R2 wherein the lengths of individual feet 260 are adjusted to bridge the gaps between the reflectors 12, 14 and the common backing truss 210. The backing structure 200 may be adjusted to accommodate a range of focal length to diameter ("F/D") ratios of the antenna reflectors. In some aspects, the distance between the backing truss 210 and the reflector 10 may be adjusted. While the length of each of the feet 260 may remain identical to each other, the distance 104A, 104B between the reflector 14 and the hubs 220 may vary.

Figure 4A:
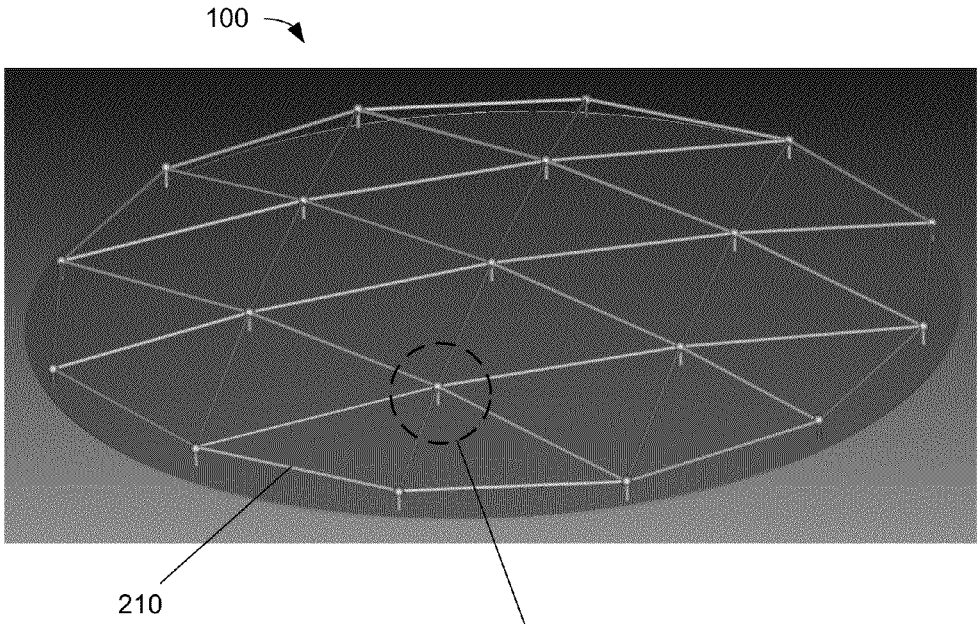
FIGS. 4A and 4B are perspective views of a backing truss and hubs according to certain aspects of the present disclosure.
Figure 4B:
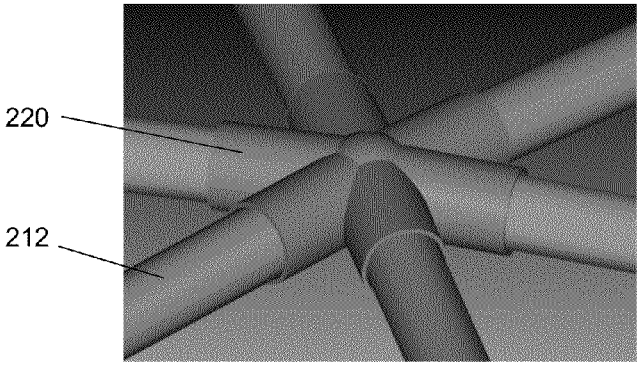

FIGS. 4A and 4B are perspective views of a backing truss 210, comprising struts 212 and hubs 220 according to certain aspects of the present disclosure. FIG. 4A depicts a backing truss 210 and indicates an example hub 220 connected to a plurality of struts 212. FIG. 4B is an enlarged view of the example hub 220 and the attached struts 212. The diameter of the hub 220's opening may be slightly larger than the outer diameter of the strut 212 so that the strut 212 may be inserted into an opening of the hub 220. In certain aspects, the struts 212 may be bonded to the hubs 220 with a structural adhesive, such as a thixotropic paste or injectable epoxy, urethane or similar adhesive, and/or mechanically fastened to achieve sufficient structural rigidity to meet the mechanical frequency requirement of the reflector assembly. In certain aspects, stowage/release fittings and boom and/or hinge/gimbal attachment ties may be incorporated into selected hub fittings and/or strut assemblies. While the disclosed backing truss 210 is shown in an exemplary triangulated configuration and the hubs 220 included in the backing truss 210 are configured to accept either four or six struts 212, FIGS. 4A and 4B are only example configurations and a backing truss 210 may be provided within any configuration of interconnected struts 212 and hubs 220.

Figure 5:
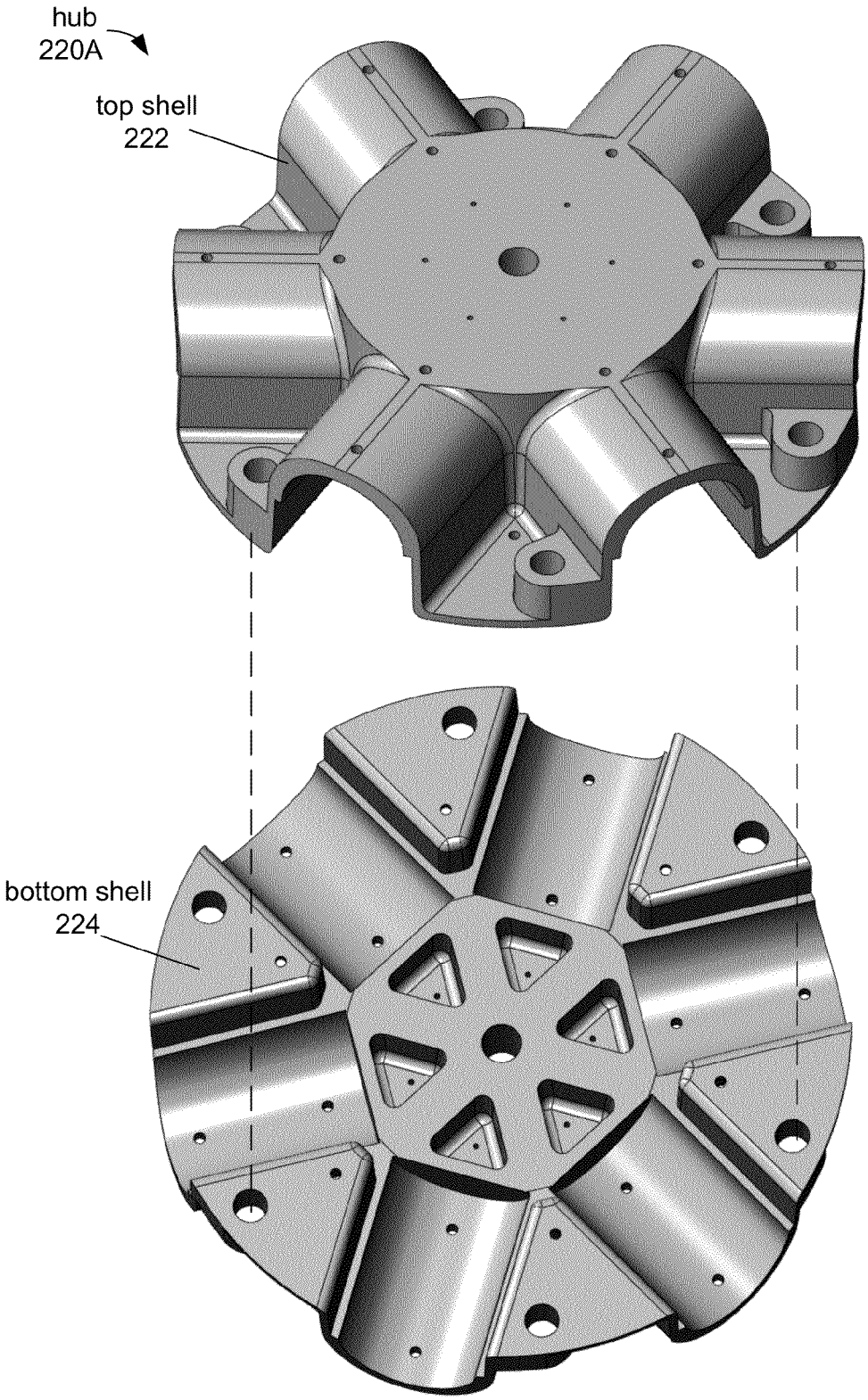
FIG. 5 is an exploded view of an exemplary hub according to certain aspects of the present disclosure.

FIG. 5 is an exploded view of an exemplary hub 220A according to certain aspects of the present disclosure. The example hub 220A comprises a top shell 222 and a bottom shell 224. This example hub 220A is approximately 3.83 inches in diameter and is generally formed of a 0.050 inch thick material. In certain aspects, the hub 220A may be smaller or larger than the example diameter and formed of thinner or thicker material. In certain aspects, the hub 220A may be formed by machining, forging, or printing a metal such as titanium or aluminum. In certain aspects, the hub 220A may be formed by molding a material that may include a reinforcing material such as graphite fibers in an engineered thermoplastic or thermoset organic resin matrix. In certain aspects, the hub 220A may be formed of any material that provides the requisite structural properties including stiffness, strength, and coefficient of thermal expansion.

The struts 212 may comprise a high-modulus material disposed within a matrix. In certain aspects, the struts may comprise a metal, such as titanium or aluminum, or a non-metal, such as graphite, aramid, or glass reinforced composite with a thermoplastic or thermoset matrix. In certain aspects, the high-modulus material may be provided as continuous fibers, chopped fibers, or a woven fabric or roving. In certain aspects, the matrix may comprise a metal, such as titanium, or an organic resin, such as an epoxy, a cyanate ester, a siloxane-cyanate ester, or engineered thermoplastic. In certain aspects, the struts are configured to provide a determined coefficient of thermal expansion. In certain aspects, the struts 212 may be provided as tube having a circular or elliptical cross-section or formed in any other profile such as an "I" beam, "T" beam, rectangular profile, or other closed or open profile. In certain aspects, the struts 212 may comprise internal structures such as a bridging membrane across a diameter of a circular profile. In certain aspects, the interior of the struts 212 may comprise a foam or other material, for example, to aid in damage resistance.

In certain aspects, the struts 212 may be bonded to the hubs 220 with a structural adhesive, such as a thixotropic paste or injectable epoxy, urethane or similar adhesive, and/or mechanically fastened to achieve sufficient structural rigidity to meet the mechanical frequency requirement of the reflector assembly. In certain aspects, stowage/release fittings and boom and/or hinge/gimbal attachment ties may be incorporated into selected hub fittings and/or strut assemblies.

Figure 6:
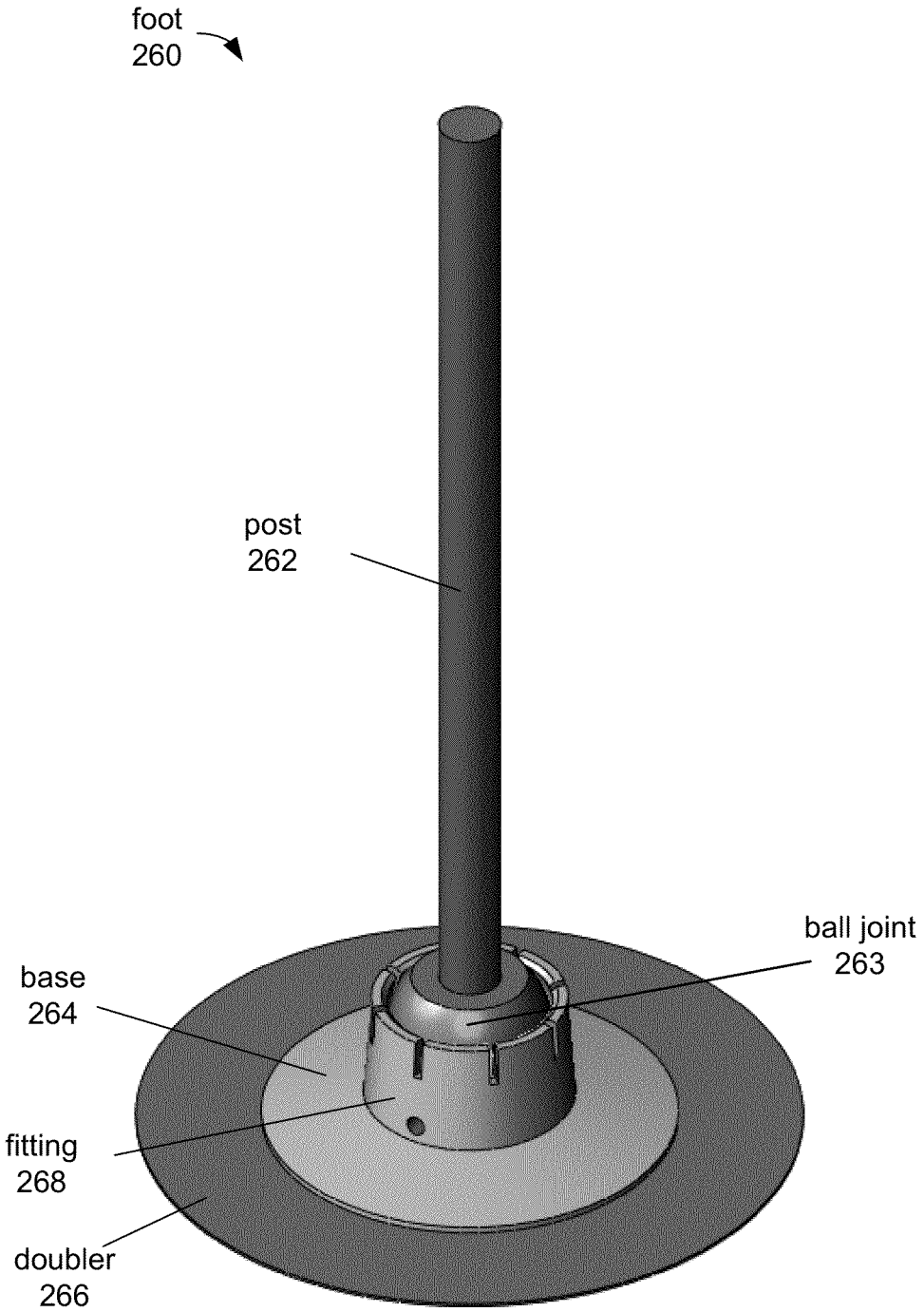
FIG. 6 is a perspective view of an exemplary foot according to certain aspects of the present disclosure.

FIG. 6 is a perspective view of an exemplary foot 260 according to certain aspects of the present disclosure. The foot 260 includes a post 262 that is coupled to a fitting 268 that, in turn, is coupled to a base 264. In certain aspects, a doubler 266 is provided between the reflector 10 (not shown in FIG. 6) and the base 264, for example to distribute the structural load from the foot 260 over a larger area of the reflector 10. In certain aspects, the fitting 268 may include a ball joint 263 or other compliant element so as to provide angular compliance and thereby avoid distortion of the surface of the reflector 10. In some aspects, the ball joint 263 may be fixed to prevent the feet 260 from tilting when the feet 260 are attached to the reflector 10. In some aspects, the ball joint 263 may be movable (or adjustable) to allow the feet 260 to accommodate the local reflector surface normal when the feet 260 are attached to the reflector 10.

In certain aspects, the foot 260 may include one or more tailored coefficient of thermal expansion (CTE) elements (not shown). In certain aspects, the foot 260 may include portions of an adjustment device (not shown) to allow the foot 260 to be moved in relation to the hub 220 (not shown) that is coupled to the post 262. The foot 260 may be attached to a reflector shell (e.g., reflector shell 280 in FIG. 2A) using a structural adhesive. In some aspects, the foot 260 is tailored to minimize mechanical and thermal loads into the reflector shell 280 to achieve a low on-orbit thermal distortion while still providing sufficient stiffness to survive launch loads.

Figure 7A:
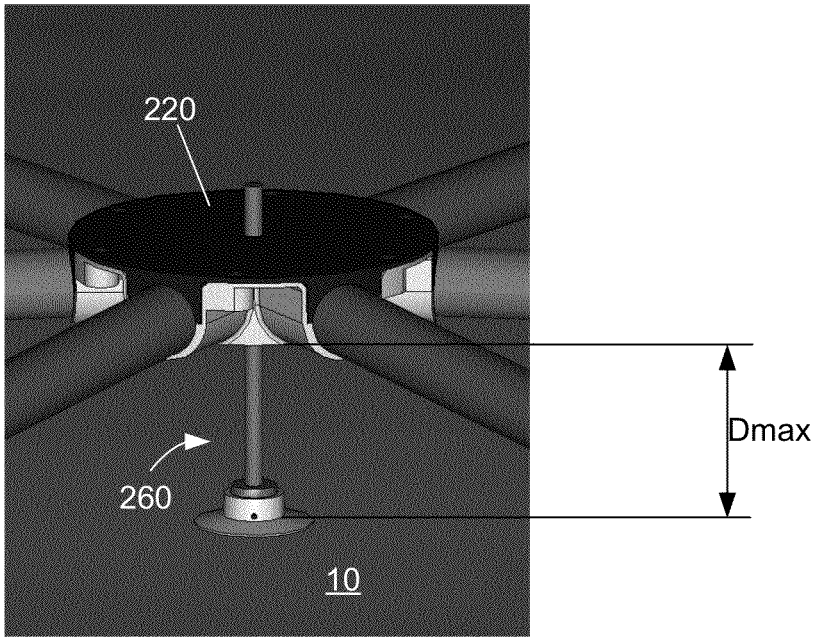
FIGS. 7A and 7B depict the range of adjustability of the foot of FIG. 6 according to certain aspects of the present disclosure.
Figure 7B:
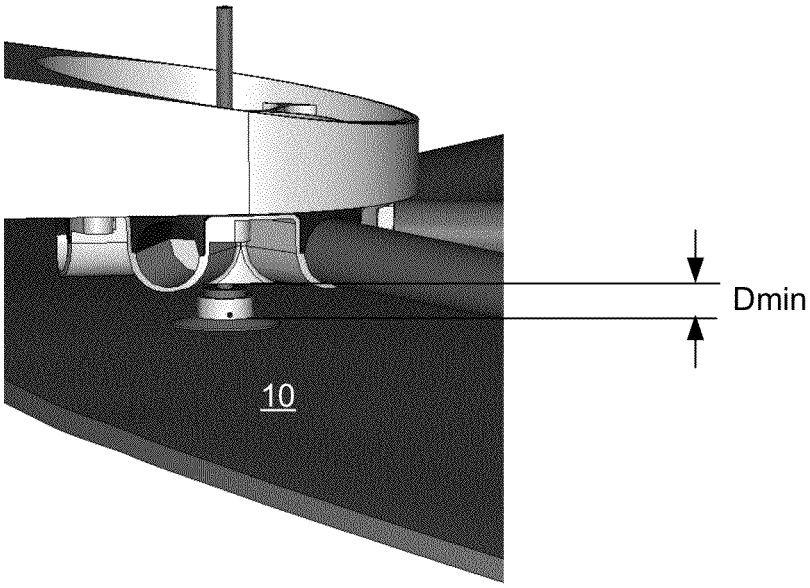

FIGS. 7A and 7B depict the range of adjustability of the foot 260 of FIG. 6 according to certain aspects of the present disclosure. In certain aspects, one or both of the hub 220 and foot 260 may comprise portions of an adjustment device (not visible) that allow the relative positions of the respective hubs 220 and feet 260 of a particular reflector support system 200 to be adjusted for the particular shape of the reflector 10. FIG. 7A depicts the foot 260 extended to a distance Dmax and FIG. 7B depicts the foot 260 refracted to a distance Dmin. In certain aspects, Dmax may be greater than or equal to 2.14 inches and Dmin may be less than or equal to 0.58 inches. The range between Dmax and Dmin must be large enough to bridge the gaps between the hubs 220 and the reflector 10 at the various locations of the hubs 220.

Figure 8A:
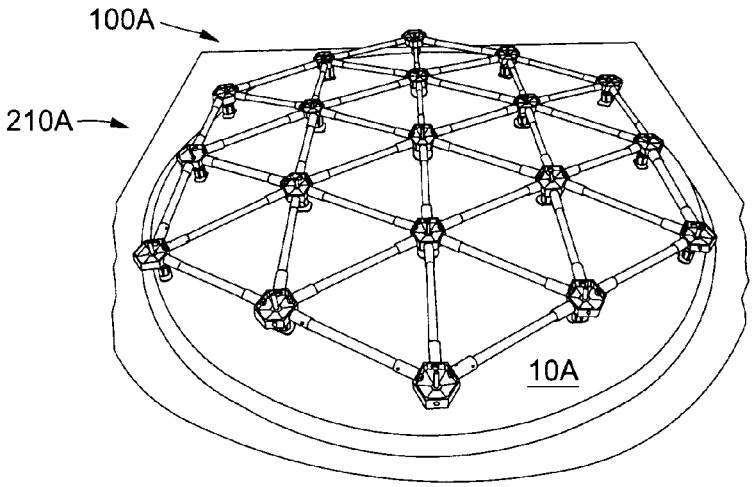
FIGS. 8A through 8C depict an example antenna reflector system according to certain aspects of the present disclosure.
Figure 8B:
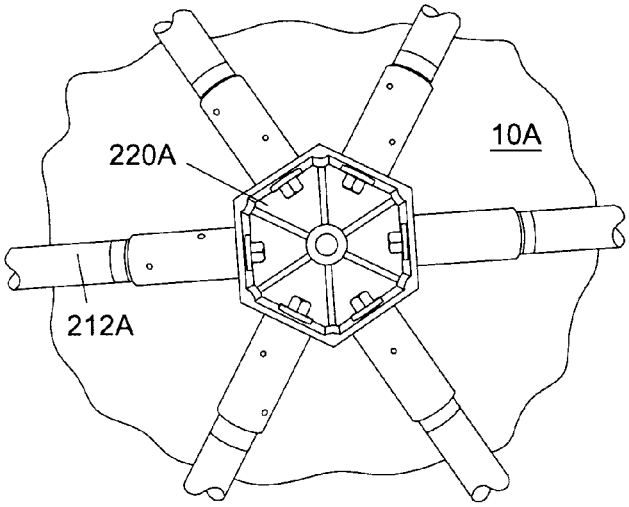
Figure 8C:
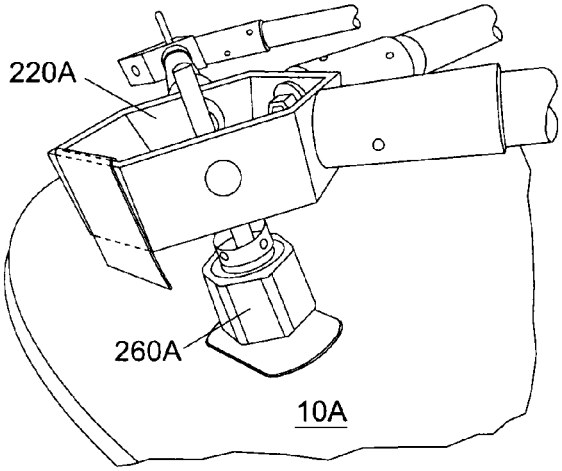

FIGS. 8A-8C depict an example antenna reflector system 100A according to certain aspects of the present disclosure. FIG. 8A shown the example system 100A as having a backing truss 210A having 19 hubs 220A formed in a triangular configuration to support a reflector 10A. FIG. 8B is an enlarged view of a hub 220A configured to accept six struts 212A. In this example, the hub 220A is formed as a hollow hexagonal box with bolts passing through each wall and into a solid end-piece of the respective strut 212A. FIG. 8C shows a foot 260A coupled between a hub 220A and the reflector 10A.

Figure 9:
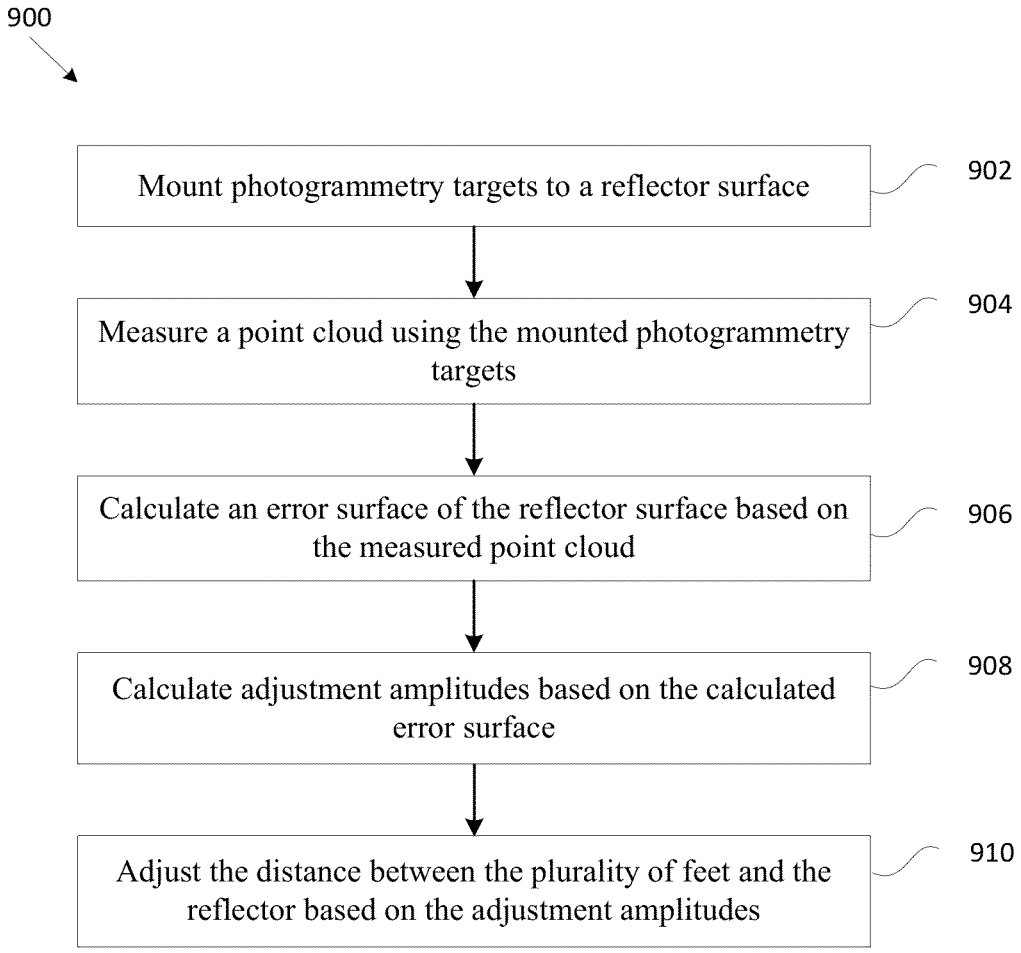
FIG. 9 illustrates an example process for corrective synthesis for mechanical adjustment of the antenna reflector system of FIG. 1.

FIG. 9 illustrates an example process 900 for corrective synthesis for mechanical adjustment of the reflector support system 200. The corrective synthesis is performed in order to implement corrections to surface distortions of the RF reflector 10. In particular, the root mean square surface error is improved by the process 900 for focused and contoured beam antenna reflectors. Surface distortions may be due to manufacturing process variations or environmental stress due to thermal or hygroscopic effects.

In some aspects, the backing structure 200 may have fittings at each node in the backing structure 200 and may provide connection points for the backing structural elements (e.g., feet 260). The feet 260 may provide a stiff structure to maintain the corrected reflector surface after applying the adjuster forces. The feet 260 may have a spherical ball bearing joint and variable stroke that may be mostly normal to the reflector 10 surface. These bearings may preclude localized bending moments at the reflector shell 280. The backing structure 200 may get bonded to the reflector shell 280 in a low stress configuration by supporting the reflector 10 on its mold.

The process 900 begins at block 902, in which photogrammetry targets are mounted to the reflector surface (e.g., item 290 in FIG. 2A). The photogrammetry targets are those commonly used in the art of photogrammetry.

The process 900 proceeds to block 904, in which a point cloud is measured using the mounted photogrammetry targets. In block 906, an error surface of the reflector surface is calculated, based on the measured point cloud. In block 908, adjustment amplitudes are calculated based on the calculated error surface.

In some aspects, the adjustment amplitude calculation may be done using deviation matrices. The deviation matrices may be accurate representations of the whole structure including backing structure 200 and the membrane or shell 280. The matrices may be pre-calculated once and may be used for subsequent adjustments. The deviation matrices are calculated using a finite element method ("FEM") model. The FEM model may be converted into a set of elasticity equations, which may result from the linear superposition of forces or amplitudes. The set of elasticity equations may be represented by a matrix $Q_n$ which relates the deviation $d_n$ at each node when a unit force $f_n$ is applied at a test node n.

$$d_n=[Q_n]f_n$$

The total deviation d may be determined by weighting and summing the deviation matrices at each test node. $Q_i$ is an m by n matrices, with m equal to the number of nodes in each matrix and n the number of test nodes. For example, for a 19 element UBS n=18 and m is typically around 20,000 (e.g., the number of elements in the FEM model of the reflector surface).

$$d = \sum d_n = \sum_i^n w_i$$

The weighing may be proportional to the required force at each test node. When an error surface s is available, the above equation for d may be solved by equating the deviation at each node to d and solving for w. The error surface can be approximated in closed form or determined from measured surfaces, as performed in block 906. A quintic pseudo-spline surface (QPS) expansion is fitted to measured data (e.g., the measured point cloud) and the deviation from the ideal designed surface is used as s with size equal to m. Since the set of equations derived from the finite element model is solved using a least square solver, more orthogonal test matrices may yield better resulting solutions. Placement pattern of the adjustors may determine the quality of the LMS solution.

In some aspects, after calculating the adjustment amplitudes, a predicted surface based on the adjustment amplitudes is calculated. In some aspects, the calculated error surface is compared with the calculated predicted surface.

The process 900 proceeds to block 910, in which the distance between the feet 260 and the reflector 10 may be adjusted based on the adjustment amplitudes. In some aspects, a radiation pattern may be measured to confirm required performance. New surfaces can be synthesized and adjustments may be made by repeating the process 900. A software tool that incorporates pre-calculated compliance matrices and point clouds to calculate adjustor settings and evaluate surface response from measured photogrammetry targets may be used.

In some aspects, the subject technology is related antenna reflectors, and more particularly to fast corrective synthesis for mechanical adjustment of antenna reflector surfaces. In some aspects, the subject technology may be used in various markets, including for example and without limitation, advanced sensors and materials and structure markets.

Figure 10:
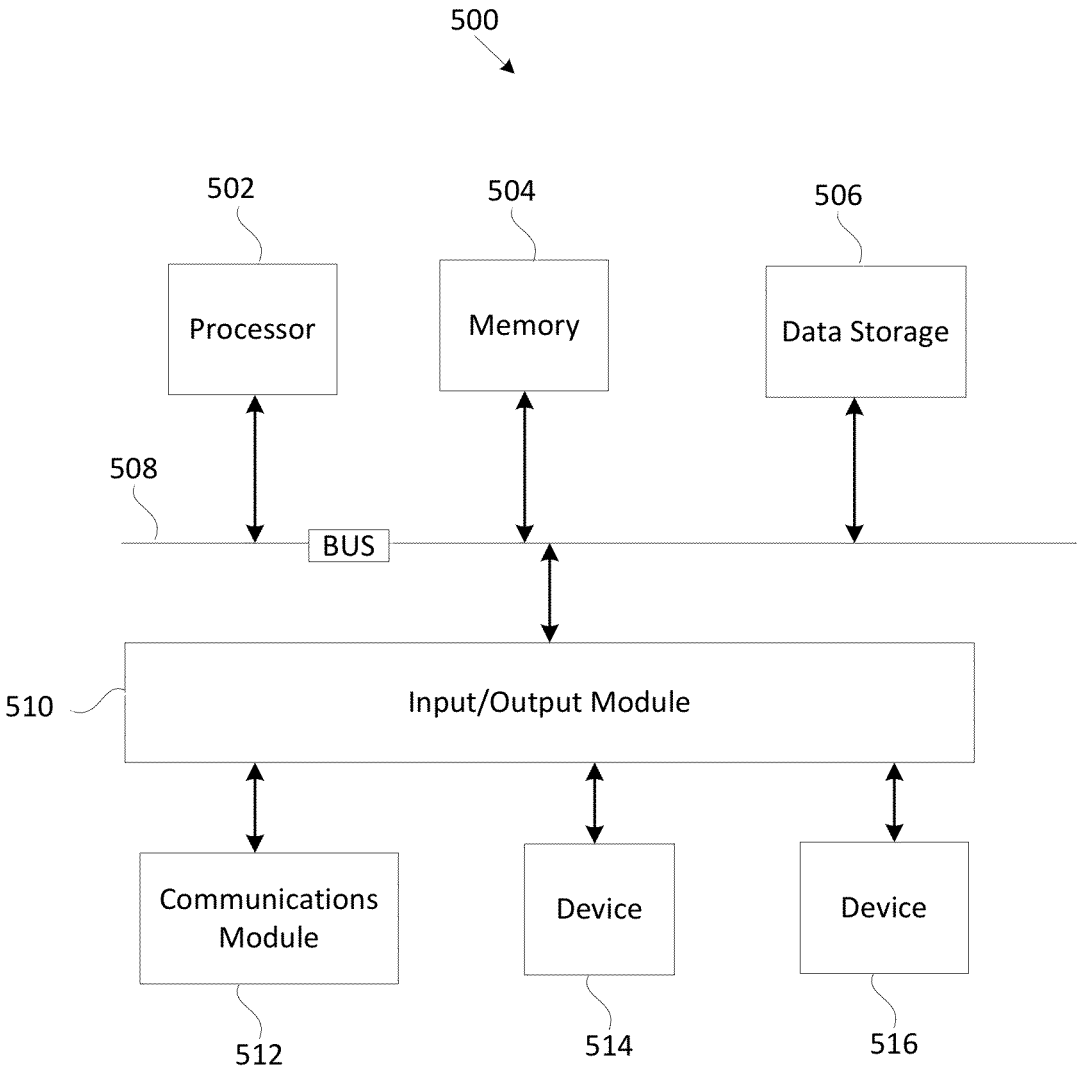
FIG. 10 is a block diagram illustrating an example computer system with which some implementations of the subject technology can be implemented.

FIG. 10 is a block diagram illustrating an example computer system 500 with which some implementations of the subject technology can be implemented. In certain aspects, the computer system 500 may be implemented using hardware or a combination of software and hardware, either in a dedicated server, or integrated into another entity, or distributed across multiple entities.

Computer system 500 includes a bus 508 or other communication mechanism for communicating information, and a processor 502 coupled with bus 508 for processing information. By way of example, the computer system 500 may be implemented with one or more processors 502. Processor 502 may be a general-purpose microprocessor, a microcontroller, a Digital Signal Processor (DSP), an Application Specific Integrated Circuit (ASIC), a Field Programmable Gate Array (FPGA), a Programmable Logic Device (PLD), a controller, a state machine, gated logic, discrete hardware components, or any other suitable entity that can perform calculations or other manipulations of information.

Computer system 500 can include, in addition to hardware, code that creates an execution environment for the computer program in question, e.g., code that constitutes processor firmware, a protocol stack, a database management system, an operating system, or a combination of one or more of them stored in an included memory 504, such as a Random Access Memory (RAM), a flash memory, a Read Only Memory (ROM), a Programmable Read-Only Memory (PROM), an Erasable PROM (EPROM), registers, a hard disk, a removable disk, a CD-ROM, a DVD, or any other suitable storage device, coupled to bus 508 for storing information and instructions to be executed by processor 502. The processor 502 and the memory 504 can be supplemented by, or incorporated in, special purpose logic circuitry.

The instructions may be stored in the memory 504 and implemented in one or more computer program products, i.e., one or more modules of computer program instructions encoded on a computer readable medium for execution by, or to control the operation of, the computer system 500. Instructions may be implemented in various computer languages. Memory 504 may be used for storing temporary variable or other intermediate information during execution of instructions to be executed by processor 502.

A computer program can be deployed to be executed on one computer or on multiple computers that are located at one site or distributed across multiple sites and interconnected by a communication network. The processes and logic flows described in this specification can be performed by one or more programmable processors executing one or more computer programs to perform functions by operating on input data and generating output.

Computer system 500 further includes a data storage device 506 such as a magnetic disk or optical disk, coupled to bus 508 for storing information and instructions. Computer system 500 may be coupled via input/output module 510 to various devices. The input/output module 510 can be any input/output module. The input/output module 510 is configured to connect to a communications module 512. Example communications modules 512 include networking interface cards. In certain aspects, the input/output module 510 is configured to connect to a plurality of devices, such as an input device 514 and/or an output device 516. Example input devices 514 include a keyboard and a pointing device. Example output devices 516 include display devices for displaying information to the user.

The term "machine-readable storage medium" or "computer readable medium" as used herein refers to any medium or media that participates in providing instructions or data to processor 502 for execution. Such a medium may take many forms, including, but not limited to, non-volatile media, and volatile media.

According to one or more implementations, the disclosed configurable reflector backing structure provides improved accuracy of the reflecting surface of an antenna reflector while reducing the cost and weight of the support structure as well as reducing the recurring design cost and development time for an antenna. The same systems and methods may be advantageously applied to other applications such as radar systems or radio telescope that may benefit from a precise reflector shape and a lightweight support structure.

This application includes description that is provided to enable a person of ordinary skill in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. It is understood that the specific order or hierarchy of steps or blocks in the processes disclosed is an illustration of exemplary approaches. Based upon design preferences, it is understood that the specific order or hierarchy of steps or blocks in the processes may be rearranged. The accompanying method claims present elements of the various steps in a sample order, and are not meant to be limited to the specific order or hierarchy presented. Thus, the claims are not intended to be limited to the aspects shown herein, but are to be accorded the full scope consistent with the language therein.

Reference to an element in the singular is not intended to mean "one and only one" unless specifically so stated, but rather "one or more." Use of the articles "a" and "an" is to be interpreted as equivalent to the phrase "at least one." Unless specifically stated otherwise, the terms "a set" and "some" refer to one or more.

Terms such as "top," "bottom," "upper," "lower," "left," "right," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Although the relationships among various components are described herein and/or are illustrated as being orthogonal or perpendicular, those components can be arranged in other configurations in some aspects. For example, the angles formed between the referenced components can be greater or less than 90 degrees in some aspects.

Although various components are illustrated as being flat and/or straight, those components can have other configurations, such as curved or tapered for example, in some aspects.

Pronouns in the masculine (e.g., his) include the feminine and neuter gender (e.g., her and its) and vice versa. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "operation for."

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

Although aspects of the present disclosure have been described and illustrated in detail, it is to be clearly understood that the same is by way of illustration and example only and is not to be taken by way of limitation, the scope of the present disclosure being limited only by the terms of the appended claims.

What is claimed is the following:

1. An antenna reflector support apparatus, comprising:

a backing structure comprising:

a plurality of struts;

a plurality of hubs, each of the plurality of hubs configured to couple to two or more of the plurality of struts, each of the plurality of hubs is configured to couple to another one of the plurality of hubs using one of the plurality of struts, each of the plurality of struts is configured to couple to at least two of the plurality of hubs; and a plurality of feet, each of the plurality of feet configured to couple to a corresponding one of the plurality of hubs, the plurality of feet are configured to couple to a reflector, and each of at least one or more of the plurality of feet comprising:

a post;

a fitting coupled to the post; and a base coupled to the fitting, the fitting comprises a movable ball joint to allow each of the at least one or more of the plurality of feet to tilt when each of the at least one or more of the plurality of feet is attached to the reflector, wherein the plurality of struts and the plurality of hubs are configured to allow the backing structure to have a grid structure.

2. The antenna reflector support apparatus of claim 1, wherein the distance between the reflector and the backing structure is adjustable.

3. The antenna reflector support apparatus of claim 1, wherein each of the at least one or more of the plurality of feet comprises a doubler.

4. The antenna reflector support apparatus of claim 1, wherein the moveable ball joint is fixable to prevent each of the at least one or more of the plurality of feet from tilting when each of the at least one or more of the plurality of feet is attached to the reflector.

5. The antenna reflector support apparatus of claim 1, wherein the plurality of hubs and the plurality of struts form a backing truss, and the backing truss is spherical.

6. The antenna reflector support apparatus of claim 1, wherein each of the plurality of hubs is coplanar with each other.

7. The antenna reflector support apparatus of claim 1, wherein each of the plurality of hubs is configured to accept four or more of the plurality of struts.

8. The antenna reflector support apparatus of claim 1, wherein:

each of the plurality of struts has the same shape and size as the other one of the plurality of struts, each of the plurality of feet has the same shape and size as the other one of the plurality of feet, each of the plurality of hubs configured to be formed at an outer edge of the backing structure has the same shape and size as the other one of the plurality of hubs configured to be formed at an outer edge of the backing structure, and each of the plurality of hubs configured to be formed within an inner portion of the backing structure has the same shape and size as the other one of the plurality of hubs configured to be formed within an inner portion of the backing structure.

9. The antenna reflector support apparatus of claim 1, wherein each of the plurality of struts is rigid, each of the plurality of hubs is rigid, and each of the plurality of feet is rigid.

10. The antenna reflector support apparatus of claim 1, wherein:

each of the plurality of hubs is attached to two or more of the plurality of struts, each of the plurality of hubs is attached to another one of the plurality of hubs using one of the plurality of struts, each of the plurality of struts is attached to at least two of the plurality of hubs, each of the plurality of feet is attached to a corresponding one of the plurality of hubs, the plurality of feet are attached to the reflector, the backing structure comprises a grid structure, a bottom shape of the backing structure, at the bottom of the plurality of feet, substantially conforms to the outer shape of the reflector, at least one of the plurality of hubs located at an edge of the backing structure is attached to a first location of a corresponding one of the plurality of feet, and at least one of the plurality of hubs located within an inner portion of the backing structure is attached to a second location of a corresponding one of the plurality of feet, wherein a distance between the first location and the reflector is greater than a distance between the second location and the reflector.

11. A method, comprising:

forming a backing structure, comprising:

a plurality of struts;

a plurality of hubs coupled to the plurality of struts; and a plurality of feet coupled to the plurality of hubs, the plurality of feet coupled to a reflector;

mounting photogrammetry targets to a surface of the reflector;

measuring a point cloud using the mounted photogrammetry targets;

calculating an error surface of the reflector surface based on the measured point cloud;

calculating adjustment amplitudes based on the calculated error surface; and adjusting the distance between the plurality of feet and the reflector based on the adjustment amplitudes.

12. The method of claim 11, further comprising:

calculating a predicted surface based on the adjustment amplitudes; and comparing the calculated error surface with the calculated predicted surface.

13. The method of claim 11, wherein the calculating adjustment amplitudes comprises using deviation matrices, wherein the deviation matrices are calculated using a finite element model of the backing structure and the reflector.

14. The method of claim 11, wherein the calculating an error surface comprises using quintic pseudosplines.

15. The method of claim 11, further comprising measuring a radiation pattern to confirm the adjusting the distance between the plurality of feet and the reflector based on the adjustment amplitudes.

* * * * *